US009289959B2

(12) United States Patent
Frangenberg

(10) Patent No.: US 9,289,959 B2
(45) Date of Patent: Mar. 22, 2016

(54) MACHINE FRAME FOR A ROLLER PRESS

(75) Inventor: Meinhard Frangenberg, Kürten (DE)

(73) Assignee: KHD HUMBOLDT WEDAG GMBH, Cologne (DE)

( * ) Notice: Subject to any disclaimer, the term of this patent is extended or adjusted under 35 U.S.C. 154(b) by 95 days.

(21) Appl. No.: 13/583,026

(22) PCT Filed: Mar. 16, 2011

(86) PCT No.: PCT/EP2011/053925
§ 371 (c)(1),
(2), (4) Date: Sep. 6, 2012

(87) PCT Pub. No.: WO2011/131427
PCT Pub. Date: Oct. 27, 2011

(65) Prior Publication Data

US 2013/0025476 A1 Jan. 31, 2013

(30) Foreign Application Priority Data

Apr. 20, 2010 (DE) ..... 10 2010 015 374

(51) Int. Cl.
*B30B 15/04* (2006.01)
*B30B 3/04* (2006.01)
*B02C 4/02* (2006.01)
*B02C 4/28* (2006.01)

(52) U.S. Cl.
CPC ... *B30B 3/04* (2013.01); *B02C 4/02* (2013.01); *B02C 4/28* (2013.01); *B30B 15/04* (2013.01)

(58) Field of Classification Search
CPC ..... B30B 15/04; B30B 3/04; B30B 15/044; B30B 15/047; B02C 4/02; B02C 4/28
USPC ..... 100/155 R, 168, 169, 176; 72/238; 241/227, 232, 285.2; 425/237
See application file for complete search history.

(56) References Cited

U.S. PATENT DOCUMENTS

| | | | | |
|---|---|---|---|---|
| 344,258 | A | 6/1886 | Dunne | |
| 3,845,708 | A * | 11/1974 | Liebert | 100/155 R |
| 3,899,965 | A * | 8/1975 | Koch et al. | 100/155 R |
| 4,225,093 | A | 9/1980 | Ruesch | |
| 4,953,458 | A * | 9/1990 | Day | 100/269.1 |
| 7,841,552 | B2 * | 11/2010 | Frangenberg et al. | 241/285.2 |
| 8,795,563 | B2 * | 8/2014 | Splinter | 264/175 |
| 2008/0017052 | A1 * | 1/2008 | Splinter et al. | 100/155 R |
| 2008/0217451 | A1 | 9/2008 | Frangenberg et al. | |
| 2010/0186607 | A1 * | 7/2010 | Horster et al. | 100/176 |
| 2010/0236430 | A1 * | 9/2010 | Al-Awadhi et al. | 100/280 |

FOREIGN PATENT DOCUMENTS

| | | | | |
|---|---|---|---|---|
| DE | 202007014764 | | 3/2009 | |
| WO | WO 2007033800 | A1 * | 3/2007 | B02C 4/02 |
| WO | WO 2009071514 | A1 * | 6/2009 | |

* cited by examiner

*Primary Examiner* — Jimmy T Nguyen
(74) *Attorney, Agent, or Firm* — Greer Burns & Crain, Ltd.

(57) ABSTRACT

A machine frame for a high-pressure roller press for receiving the rollers in the bearings of the press, including at least one first frame element below the rollers and at least one second frame element. At least one connecting element is provided for connecting the at least one first frame element to the at least one second frame element. The at least one connecting element has a U-shaped design forming two limbs. With this design, the frame can be constructed with smaller dimensions than current constructions and in one piece, because no releasable connections are necessary with this configuration of the machine frame. This design saves weight.

4 Claims, 3 Drawing Sheets

MACHINE FRAME FOR A ROLLER PRESS

BACKGROUND OF THE INVENTION

The invention relates to a machine frame for a high pressure roller press for receiving the rollers in their bearings, comprising at least one first frame element below the rollers, at least one second frame element above the rollers, and at least one connecting element for connecting the at least one first frame element to the at least one second frame element.

For the high pressure comminution of bulk material, it is known to pass the bulk material through the roller nip between two contrarotating rollers, where the bulk material breaks up through the application of high pressure and is pressed into flakes. In this type of comminution, the material to be comminuted is not comminuted with a shearing motion, but ideally solely by the application of high pressure to the bulk material in the roller nip, where the bulk material breaks up solely as a result of the pressure application.

The generated forces in the machine frame which holds together the two contrarotating rollers are in this case very high. Accordingly, it is endeavored to design the machine frame such that it is suitably stable. As a result of the stable machine frame, the high pressure roller press quickly acquires a high weight. The handling of single components of the frame of the high pressure roller press, and the transport of the roller press, are thereby made more difficult. High costs are incurred when transporting the machine parts into the district of use of the roller press, wherein the districts of use are frequently less developed mining regions remote from any infrastructure.

In order to reduce the weight of the entire construction, there has already been a move to statically calculate the single components individually in order thereby to save weight at the places at which this is possible. A further drawback of heavy single components of the high pressure roller press is given when the high pressure roller press is erected at sites at which there is little infrastructure available for maintaining and repairing the high pressure roller presses. In fields of use of the kind in which the service life of the roller press has considerable influence on the economic viability of the mine or of the material to be produced, there has therefore been a move toward roller press constructions which allow the rollers to be serviced or changed with little effort.

For the abovementioned reasons, it is desirable to constantly improve the frame construction of roller presses and, at the same time, reduce the weight and complexity.

SUMMARY OF THE INVENTION

The object of the invention is therefore to provide a machine frame for a roller press, which machine frame has a reduced own weight combined, at the same time, with high stability.

The object according to the invention is achieved by virtue of the fact that the at least one connecting element is of U-shaped configuration, with the formation of two side members. Further advantageous embodiments of the invention are defined in the subclaims.

According to the invention, it is provided that a U-shaped connecting element is arranged between a top-situated frame and a bottom-situated frame element. In this configuration, said connecting element for the two top and bottom frame parts absorbs the principal forces of the roller press construction, because the type of force guidance is geared to subjecting this connecting element only to tensile load, wherein a self-contained system of forces is constructed. This central frame element is protected against deformation by the upper and lower frame components and these serve as the assembly frame.

As a result of the U-shaped configuration, which is possible only by virtue of the frame design (described in greater detail below), it is possible to dispense with bolt, rivet and screw joints in the central part of the machine frame and to configure the machine frame such that it is produced solely by permanent weld joints. The middle part of the machine frame which is presented here, the connecting element, can be dimensioned smaller by virtue of the missing weakenings in the form of boreholes for bolts, rivets and screws. Hence the weight of the machine frame is reduced and handling during production is made substantially easier; thus the frame becomes cheaper and saves on transport weight.

Insofar as the frame has been produced solely by weld joints, the single-part construction allows a faster production method, since no precisely positioned boreholes need to be made. This frame element can be constructed lying on the ground and does not need to be turned by cranes in the course of production.

In one embodiment of the machine frame, it is provided that the connecting element has on the inner side of the side members at least one rail for the reception of bearings movable on this rail. The rails allow sliding of the movable roller, together with the bearings receiving the rollers, within predefined limits during operation. Furthermore, the rollers are able to be pushed or pulled out of the connecting element, so that no complex dismantling of the high pressure roller press is necessary.

To enable the rollers to be pushed or pulled out of the machine frame, this U-shaped element lies on the side, whereby the side members are oriented in the horizontal and a section connecting the side members is vertically oriented. For the closure of the frame, a frame section is slipped over the U-shaped, laterally open connecting element and firmly closed there.

The section connecting the side members receives for the application of the high pressing force a hydraulic ram, wherein the section connecting the side members has a reinforcement in order to be able to absorb the forces without mechanical failure. In order to distribute the forces evenly over the lightweight construction, a carrier plate is provided, which latter is disposed between the hydraulic ram to be received and the section connecting the side members.

On the side situated opposite the section connecting the side members, the connecting element is open. At this location is provided a closure element, with the aid of which a frame section can be used to close the connecting element to create an annular frame. The closure elements, in the concrete case hammerhead-shaped ends of the side members of the connecting element, here absorb the forces of the hydraulic ram on the side situated opposite the hydraulic ram.

The force is here transmitted from the hydraulic ram to one of the bearings of the rollers, and from there via a plurality of elements to the closure element. The rollers are not fixedly disposed in the machine frame, however, but can perform compensating motions. To this end, it is provided that at least one side member of the connecting element has on the inner side a rail for the reception of bearings movable on this rail. On this rail, the bearings, in predefined stretches, can perform compensating motions to enable larger elements to pass through the roller nip without blocking the rollers.

BRIEF DESCRIPTION OF THE DRAWINGS

The invention is explained in greater detail with reference to the following figures, wherein.

DETAILED DESCRIPTION OF THE PREFERRED EMBODIMENTS

Figure 1:
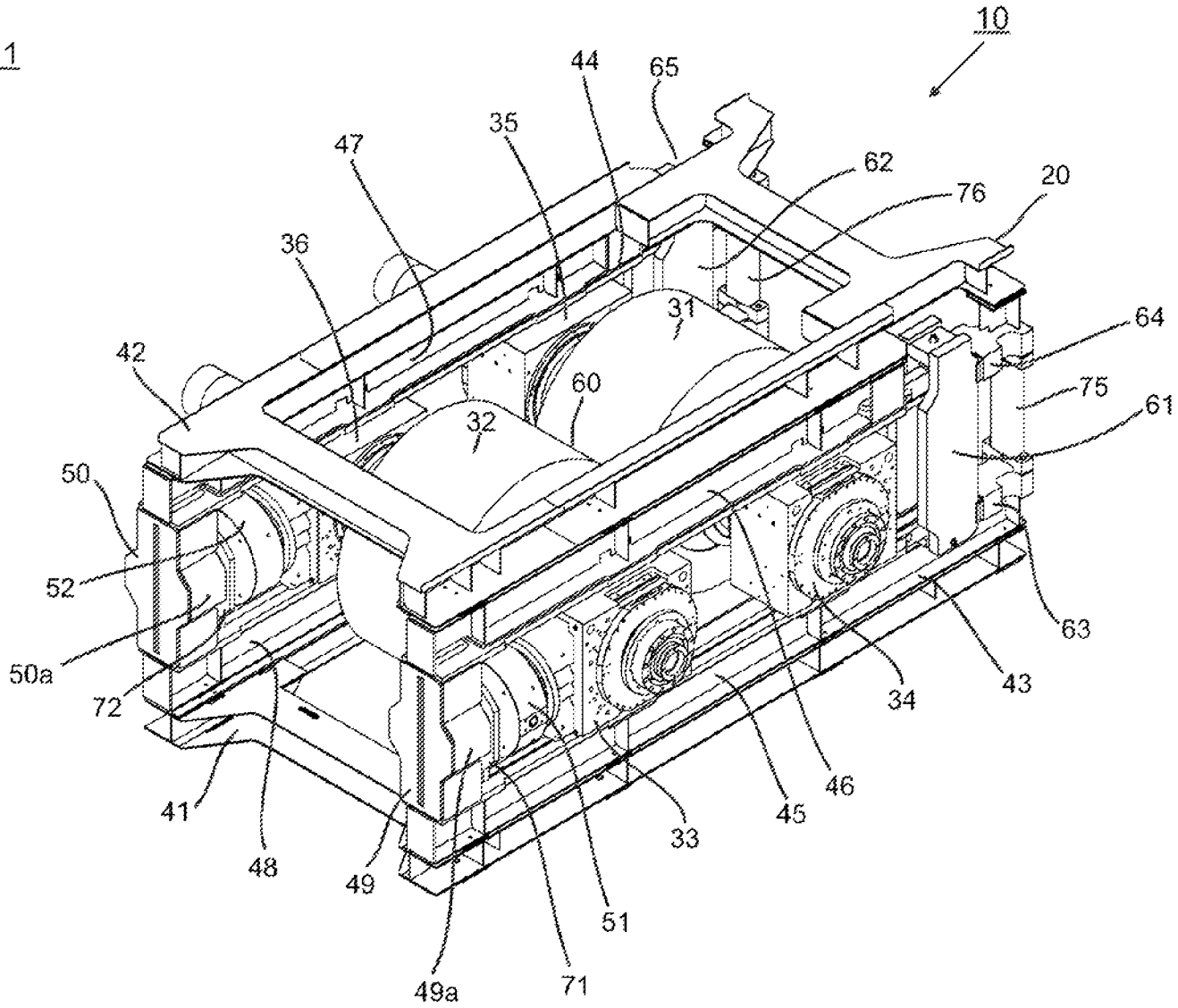
FIG. 1 shows a high pressure roller press having the machine frame according to the invention in a perspective view.

In FIG. 1, a high pressure roller press 10 is portrayed in a perspective view, comprising the multipart machine frame 20, the rollers 31 and 32, and the four bearings 33, 34, 35 and 36. The multipart machine frame 20 is comprised, for its part, of a first frame element 41 below the rollers 31 and 32, a frame element 42 above the rollers 31 and 32, and two connecting elements 43 and 44. These connecting elements 43 and 44 each form two side members 45 and 46, and 47 and 48, which are connected to one another by connecting sections 49 and 50. The side members 45 and 46, and 47 and 48, of the connecting elements 43 and 44 serve, for their part, as the base for slide rails for the movably installed bearings 33, 34, 35 and 36, wherein, according to the design of the high pressure roller press 10, the bearings 33 and 34 disposed in the foreground of the diagram are configured as fixed bearings and the bearings 35 and 36 disposed in the background of the diagram are configured as movable bearings. The bearings 33 and 36, which are accommodated within the connecting elements 43 and 44, are forced by hydraulic rams 51 and 52 into the middle of the machine frame counter to the force of the grinding stock flowing through the nip 60 between the rollers 31 and 32. The forces of the hydraulic rams 51 and 52 subject the side members 45 and 46, and 47 and 48, of the connecting elements 43 and 44 to tensile load, since the abovementioned forces are transmitted from the respectively, in the diagram, front connecting sections 49 and 50, via the bearings 33 and 36 and the roller 32, the nip 60 between the rollers 31 and 32, from there to the roller 31 and from here, in turn, to the bearings 34 and 35. This roller 31, in this embodiment configured as a fixed roller, with the bearing 34 configured as a fixed bearing and the bearing 35 configured as a movable bearing, is supported against a respective frame section 61 and 62, which frame sections are both respectively slipped over the respectively upper side member 46 and 47 and received and closed off in a closure element 63 and 64, in which the frame sections 61 and 62 are closed below the respectively bottom side members 45 and 48 and are supported on the hammerhead-shaped ends of the side members 45, 46, 47 and 48, which ends serve as a closure element 63 and 64, and 65 and 66. Within the entire frame, the connecting elements 43 and 44 form, in conjunction with the frame sections 61 and 62, a self-contained system for the absorption of forces exerted by the hydraulic rams 51 and 52.

Particular to this construction is the fact that the overall structure of the machine frame is in one part and turns out to be particularly light, because the parts which are subjected to tensile load and form a self-contained system of forces have no screw joints or rivet joints. Because these are free from screw joints and rivet joints, the top and bottom chords and beams of the side members 45, 46, 47 and 48 can be dimensioned smaller. In order to change the bearings 33, 34, 35 and 36 or and/or the rollers 31 and 32, it is sufficient to remove respectively one of the frame sections 61 and 62 and pull out the bearings, together with the rollers 31 and 32 supported by the bearings 33, 34, and 36, rearward in this perspective. The lower and upper frame elements 41 and 42 lend the entire machine frame 20 the necessary stability against torsions and ensure that the overall construction of the machine frame suffers no deformation through parallel displacement. Stays 75 and 76 behind the closure elements 61 and 62 hold together the respectively two side members 45 and 46, and 47 and 48, of the connecting elements 43 and 44 and ensure that the frame weight does not put load upon the bearings, so that, during operation of the high pressure roller press 10, the bearings, together with the rollers 31 and 32, can perform compensating motions which are as low in friction as possible. Without the stays 75 and 76, the weight of the upper frame element 42 would, during operation, put load upon the sliding plane of the bearings 33, 34, 35, and 36, whereby the compensating motions would be made more difficult and the wear upon the slide rails 81, 81', 82 and 82' would turn out to be unnecessarily high.

In order to be able to absorb the high forces of the hydraulic rams 51 and 52, it is provided that the connecting sections 49 and 50 respectively have a reinforcement 49*a* and 50*a* and, where necessary, also a carrier plate 71 and 72, to prevent mechanical failure of the connecting sections 49 and 50 under the load of the hydraulic rams 51 and 52.

Figure 2:
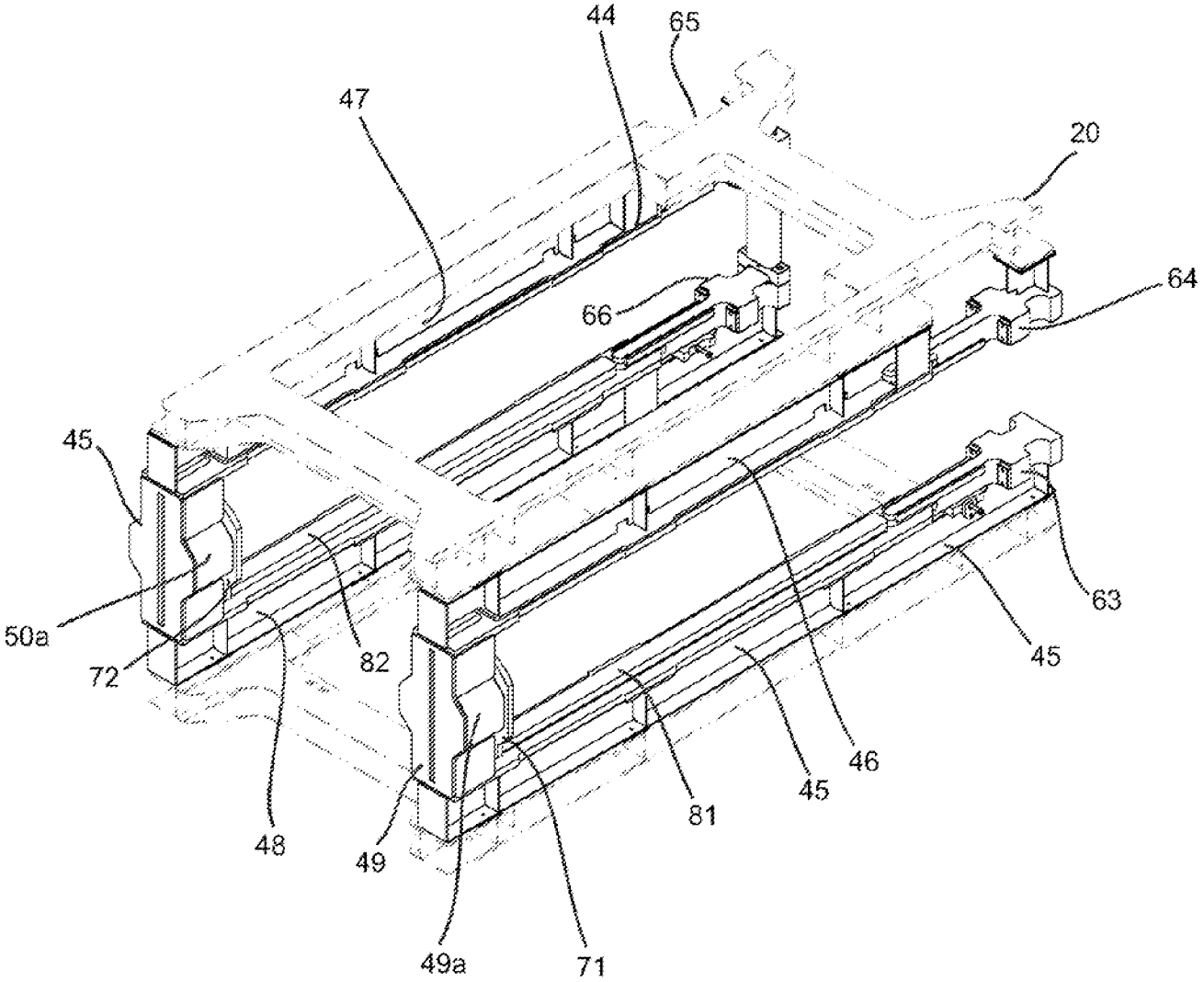
FIG. 2 shows the entire machine frame of the high pressure roller press having mutually offset frame components.

In FIG. 2, that part of the machine frame 20 which is fundamental to the invention, namely the at least one connecting element 43 and 44, is illustrated by dashed and solid lines. As opposed to the representation in FIG. 1, in this figure the hydraulic rams 51 and 52, the rollers 31 and 32, frame sections 61 and 62, and stays 75 and 76 present in the vicinity of the frame sections 61 and 62 are blanked out. In order to better demarcate the two connecting elements 43 and 44 from the frame elements 41 and 42, the frame elements 41 and 42 are in dashed representation, while the connecting elements 43 and 44 are represented with continuous lines.

In comparable frame constructions, the frame components, which are made up of individual sections and are similar to the connecting elements 43 and 44, are connected to one another by bolt, rivet and screw joints. The construction of this central component of the machine frame 20 is hence complex and expensive. However, it has previously been necessary to construct this frame component by using releasable joints to enable the rollers 31 and 32 to be released, or even lifted out from the frame for maintenance purposes. Since this frame is open on the, in this view, rearward-pointing side, the rollers can be pushed or pulled out rearward by displacement of the bearings 33, 34, 35 and 36 on the rails 81 and 81', which rails are visible in this view. Thus it is not necessary for the connecting element 43 to be made removable, and assembly elements such as screws and rivets are able to be dispensed with in this construction. Without weakening of the beams and upper and lower chords of the connecting elements 43 and 44, the steel beams, from which the connecting elements 43 and 44 are produced, can be designed in smaller dimensions, which, given the size of the frame, which weighs a few tonnes, allows an appreciable weight saving. This saving makes itself felt not only in respect of transport, but also in respect of assembly, because the connecting elements can be constructed by welding and handling during production thereby becomes easier.

Figure 3:
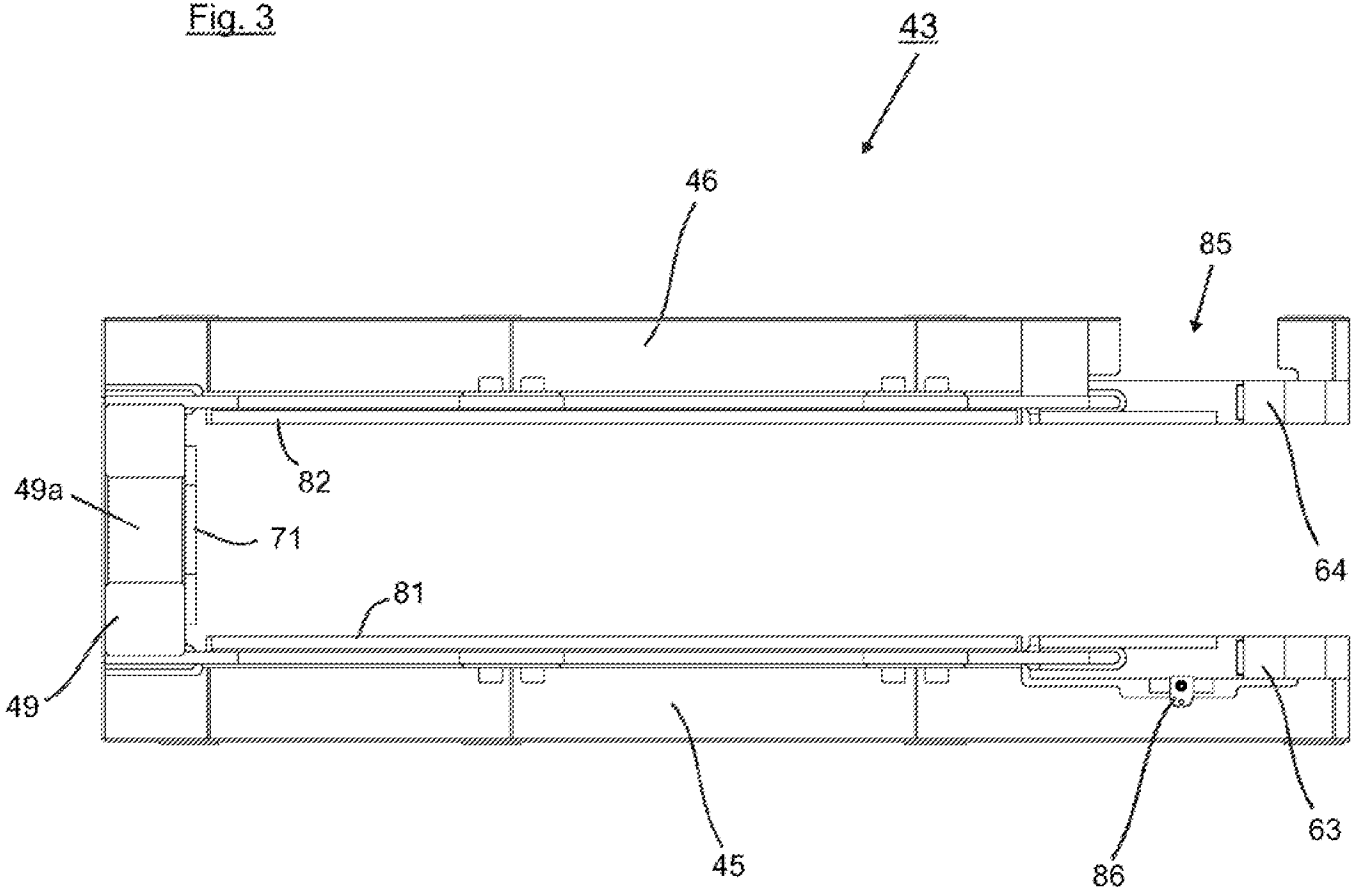
FIG. 3 shows the machine frame according to the invention in a side view.

Finally, in FIG. 3, one of the connecting elements 43 and 44 is represented in a side view. The U-shape, lying on the side, is clearly apparent, in which U-shape the connecting element 43 forms two, during use, horizontally lying side members 45 and 46, which are connected to each other by a, during use, vertically oriented, connecting section 49. On the inner side of the section 49 is disposed a carrier plate 71 for the reception of the hydraulic cylinder 51 represented in FIG. 1. During operation of the roller press, the bearing 33 accommodated in the connecting element 49 (FIG. 1) slides to and fro on the rail 81 within the scope of the possible compensating motion of the roller 32. For the removal of the rollers 31 and 32 (FIG. 1), it is provided that the rollers are moved to the right out of the connecting element 43, the connecting element 43 here being represented open. The frame is closed by a frame section 61 (likewise shown in FIG. 1), which is slipped from above over the upper side member 46 and is lowered into the receiving bay 85. The frame section 61 here also reaches over the lower side member 45 and is closed off with the aid of the fixing element 86. By contrast, the forces of the rollers and of the hydraulic ram 51 (FIG. 1) are transmitted from the frame section 61 (not illustrated here) to the hammerhead-shaped closure elements 63 and 64.

In order to transmit the forces of the roller system optimally to the hammerhead-shaped closure elements 63, 64, 65 and 66, it is provided that, optionally, the frame sections 61 and 62 are not fixedly connected to the side members 45 and 46, and 47 and 48. In this way, the frame sections 61 and 62 can transmit their force evenly to the hammerhead-shaped closure elements 63, 64, 65 and 66 in the dynamically loaded machine frame 20.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

REFERENCE SYMBOL LIST

10 high pressure roller press
20 machine frame
31 roller
32 roller
33 bearing
34 bearing
35 bearing
36 bearing
41 frame element
42 frame element
43 connecting element
44 connecting element
45 side member
46 side member
47 side member
48 side member
49 section
50 section
51 hydraulic ram
52 hydraulic ram
60 nip
61 frame section
62 frame section
63 closure element
64 closure element
65 closure element
66 closure element
71 carrier plate
72 carrier plate
75 stay
76 stay
81 rail
82 rail
85 receiving bay
86 fixing element

The invention claimed is:

1. A machine frame for a high pressure roller press for receiving a pair of rollers in their bearings, comprising:

at least one first frame element extending below both of the rollers, at least one second frame element extending above both of the rollers, and at least one connecting element for connecting the at least one first frame element to the at least one second frame element, wherein the at least one connecting element is of U-shaped configuration, with the formation of two side members, and wherein:

said at least one connecting element comprises a first U-shaped connecting element and a second U-shaped connecting element, whereby each of said first and second connecting elements includes two of said side members; and at least one of said first frame element and said second frame element comprises: (i) two first portions extending parallel to said side members of said connecting elements and (ii) a second portion that connects said two first portions together.

2. The machine frame of claim 1, wherein said second portion extends generally perpendicular to said two first portions.

3. A machine frame for a high pressure roller press for receiving a pair of horizontally opposed rollers in their bearings, comprising:

at least one first frame element extending below both of the rollers, at least one second frame element extended above both of the rollers, and at least one U-shaped connecting element arranged to connect the at least one first frame element to the at least one second frame element, wherein the U-shaped connecting element includes two side members comprising two long legs of the U-shape, wherein:

said at least one U-shaped connecting element comprises a first U-shaped connecting element and a second U-shaped connecting element, whereby each of said first and second U-shaped connecting elements includes two of said side members; and at least one of said first frame element and said second frame element comprises: (i) two first portions extending parallel to said side members of said U-shaped connecting elements and (ii) a second portion that connects said two first portions together.

4. The machine frame of claim 3, wherein said second portion extends generally perpendicular to said two first portions.

* * * * *